United States Patent [19]

Düssel et al.

[11] Patent Number: 4,565,417

[45] Date of Patent: Jan. 21, 1986

[54] SINGLE POLE PLUG CONNECTOR ARRANGED AT THE END OF A SINGLE CONDUCTOR SHIELDED ELECTRIC CABLE

[75] Inventors: Klaus Düssel, Mitwitz; Werner Orlowski, Erlangen; Gerhard Ott; Hans Toczelowski, both of Neustadt, all of Fed. Rep. of Germany

[73] Assignee: Siemens Aktiengesellschaft, Munich, Fed. Rep. of Germany

[21] Appl. No.: 708,449

[22] Filed: Mar. 5, 1985

[30] Foreign Application Priority Data

Mar. 6, 1984 [DE] Fed. Rep. of Germany ..... 3408525

[51] Int. Cl.[4] ..... H01R 4/00

[52] U.S. Cl. ..... 339/94 C; 339/103 R; 339/14 P; 339/DIG. 1; 339/217 R; 339/213 R

[58] Field of Search ..... 339/14, 13, 103, 218 R, 339/218 M, 148, 94, 177 R, 177 E, 143 R, 213 R

[56] References Cited

U.S. PATENT DOCUMENTS

| | | | |
|---|---|---|---|
| 3,062,495 | 3/1962 | Quackenbush | 339/103 R |
| 3,294,894 | 12/1966 | Stillman, Jr. | 339/103 R |
| 3,455,336 | 7/1969 | Ellis | 339/DIG. 1 |
| 3,739,320 | 6/1973 | Flanagan | 339/103 R |
| 3,777,050 | 12/1973 | Silva | 339/14 R |
| 3,805,218 | 4/1974 | Voida | 339/148 |
| 3,851,296 | 11/1974 | Muchmore et al. | 339/94 M |
| 4,032,205 | 6/1977 | Taj | 339/13 |

FOREIGN PATENT DOCUMENTS

| | | |
|---|---|---|
| 0039601 | 5/1981 | European Pat. Off. . |
| 1148613 | 12/1963 | Fed. Rep. of Germany . |
| 3012971 | 10/1980 | Fed. Rep. of Germany . |
| 2625893 | 6/1981 | Fed. Rep. of Germany . |
| 921595 | 3/1963 | United Kingdom . |

*Primary Examiner*—Gil Weidenfeld
*Assistant Examiner*—David L. Pirlot
*Attorney, Agent, or Firm*—Kenyon & Kenyon

[57] ABSTRACT

For a single pole plug connector arranged at the end of a single conductor shielded cable, an insulator is used which is slipped on an appropriately prepared cable end. A sealing sleeve is disposed between the insulator and the shield wires folded over backwards on the cable jacket. The shield wires are then brought through a finger-like extension of an elastic cap by means of a connnecting lead, the cap resting also on the insulator and the cable jacket. The shield side end of the connecting lead is fixed relative to the cable by a hose clamp.

12 Claims, 2 Drawing Figures

SINGLE POLE PLUG CONNECTOR ARRANGED AT THE END OF A SINGLE CONDUCTOR SHIELDED ELECTRIC CABLE

BACKGROUND OF THE INVENTION

This invention relates to fittings for electric cables in general and more particularly, to the design of a single pole plug connector which is arranged at the end of a single conductor shielded cable and comprises an insulator of an elastomeric material sealed from the end of the cable.

For the power supply of beacons in airports, shielded single conductor electric cables with a plastic jacket are used, among other things. These cables form one or more series circuits, into which the leads of the beacons are looped. The leads can be connected to the cables via a single pole plug connection. For this purpose, the ends of the leads as well as the ends of the cables are provided with appropriate plug connectors, in which the plug connector part (plug or jack, respectively), to be connected to the respective cable end is surrounded by an insulator of natural or synthetic rubber.

In one plug connector known for these purposes, the insulator surrounds the recessed cable end in the form of a hollow cylindrical body which is open toward the cable and is provided on its inside with spaced projections. The space between the insulator forms a mold and the end of the body is filled with a casting resin, where the cable shield is brought out of the opening of the insulator backwards. Such a plug connector can be produced simply and efficiently and is distinguished by a moisture-proof and mechanically highly stressable connection of the insulator and the end of the cable. The cast resin body represents, in this case, the moisture protecting connecting link between the insulator and the cable jacket and the cable insulation. See German Pat. No. 26 25 893.

For making plug connectors in unshielded power cables, prefabricated insulators are known per se which consist of elastomeric material and which can be pushed on the properly prepared cable end, expanding elastically. See German Pat. No. 11 48 613.

For installing electric cables, fittings are otherwise known which consist of heat-shrinkable plastic bodies. Among them are included, for instance, udder-shaped parts for fanning out terminations (See European Patent EP-OS No. 0 039 601) or also two layer cylindrical parts, of which the one layer is stressed only elastically (See German patent DE-OS No. 30 12 971, FIG. 7A).

Starting from a single pole plug connector installed at one cable end with the features described in German Pat. No. 26 25 893, it is an object of the present invention to further simplify the installation of the plug connector to the cable end, omitting the cast resin body and using exclusively prefabricated parts and elements and to ensure the applicability of the plug connector to cables with different plastic jackets (polyvinylchloride, polyethylene, natural or synthetic rubber).

SUMMARY OF THE INVENTION

According to the present invention, the above and other objects are attained by folding back the shield wires of the cable within the insulator backwards on the stepped back cable jacket and surrounding them with a sealing sleeve; seating the insulator with its entire inside surface elastically on the stepped back cable end with the interposition of a thin lubricating and sealing layer; providing an elastic cap at the transition from the insulator to the cable which on one side rests against the insulator and the connecting lead, forming an elastic seal; and surrounding the cable and the lead together with a hose clamp in the region of the finger-like extensions.

In a plug connector designed in this manner, the required tightness of the plug connector against moisture is ensured by the exclusive use of elastic parts which are seated on the end of the cable and the lead wire, these parts being expanded elastically. Optionally, the corresponding sealing surfaces of the insulator and the cap can be coated with an adhesive or a gel-like sealing compound. This is appropriate particularly if heat-shrinkable parts are used entirely or partially as the elastic parts. The hose clamp which is provided according to the present invention and surrounds the lead and the cable directly or indirectly with the interposition of the finger-like extensions of the elastic cap, ensures mechanical protection of the cap against stresses which may occur due to the further handling and installation of the lead.

DETAILED DESCRIPTION

Figure 1:
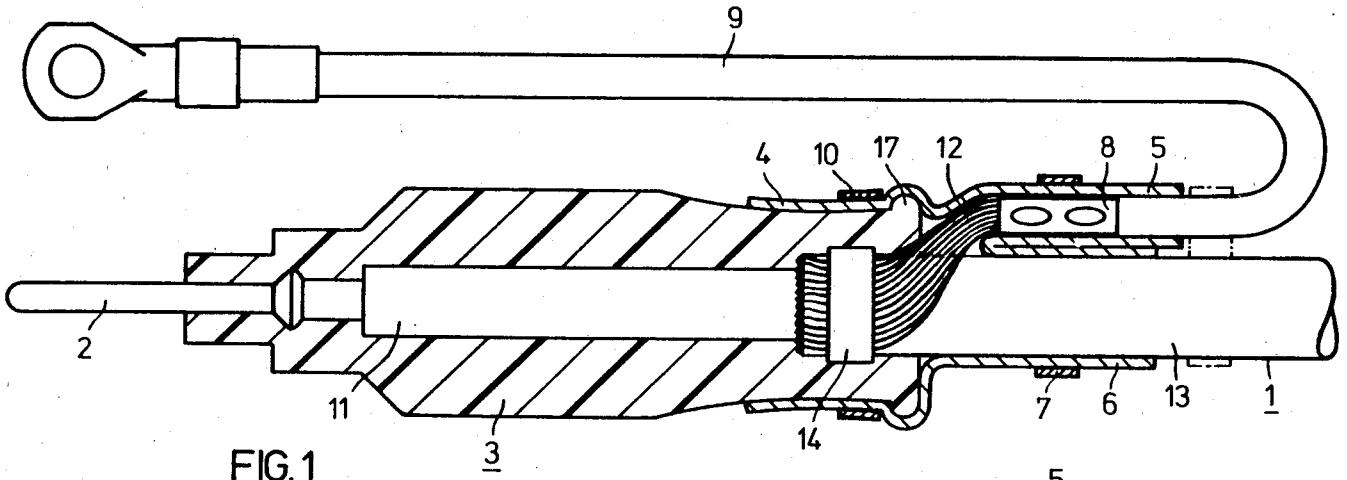
FIG. 1 is a cross sectional view of an embodiment of a plug connector according to the present invention.

FIG. 1 shows an end of a single-conductor shielded power cable 1 designed as a plug. The conductor is not shown in detail. The conductor is surrounded by insulation 11, to which a concentric shield 12, consisting of wires, and a plastic jacket 13 are applied. The plug at the cable end includes a plug part 2, which is pushed onto the conductor of the cable or is soldered thereto. The plug part 2 is surrounded by an insulator 3 which is pushed-on, being slightly expanded elastically. Insulator 3 is also seated elastically on the insulator 11 and the jacket 13 of the appropriately prepared cable end. For this purpose, the shield wires 12 of the cable 1 are first folded back onto the cable jacket 13 in order to ensure a uniform distribution of the shield wires on the cable jacket in the vicinity of the insulator 3. The folded over portion of the shield wires 12 is provided with a sealing sleeve 14 which ensures a seal between the rear end of the insulator and the cable jacket. This sealing sleeve may be, in the simplest case, a paste-like sealing compound, for instance, silicon grease. However, it may also be an elastic sleeve which is slipped over the shield wires, optionally additionally using an adhesive or a sealing agent, expanding elastically; for instance, a sleeve of a polyolefin body, a silicone rubber body or an elastomer part. However, a heat-shrinkable part can also be used. When the insulator 3 which is optionally coated on its inside surface with a lubricating or sealing agent, is slipped on, it is also expanded elastically when it is slipped onto the part of the cable jacket covered by the shield wires and subsequently is seated tightly on this area.

Onto the end of the insulator 3 on the cable side is further placed the elastic cap 4 which has two finger-shaped extensions 5 and 6 for bringing through the cable 1 and the lead 9, the conductor of which is connected via a pressure joint 8 to the shield wires which are combined in a braid. The elastic cap, which may consist likewise of an elastic polyolefin material, silicone rubber or an elastomer, is fixed on the insulator by means of a hose clamp 10 which rests against the shoulder 17 of the insulator. The end of the lead 9 on the shield side is furthermore fixed relative to the cable 1 by means of the hose clamp 7 in order to preclude mechanical stress of the finger-like extension 5 at the transition to the cap 4 and the finger-like extension 6.

A heat-shrinkable part can also be used for the elastic cap 4. If the cap is coated on its inside with a hot-melting adhesive, the use of the hose clamp 10 can optionally be dispensed with in this case.

Figure 2:
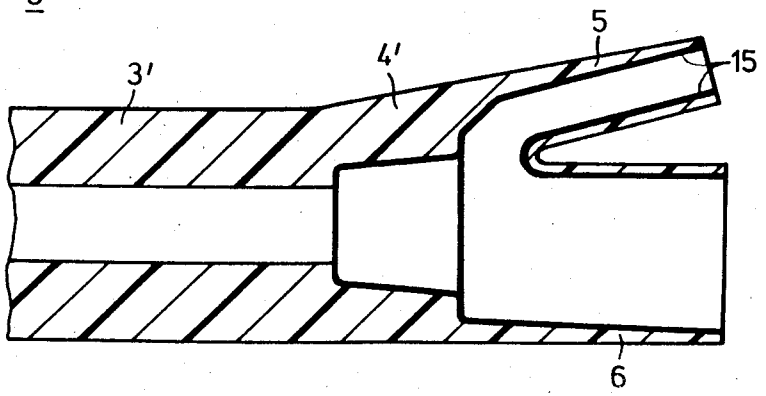
FIG. 2 is a cross-sectional view of an alternative design for the insulator of the plug connector.

FIG. 2 shows an embodiment for the insulator 3, in which the cap 4 is designed as a heat-shrinkable part and is integrated into the insulator 3. The insulator 3 is divided into the elastic region 3' which rests substantially on the plug connector 2 and the cable insulation 11, and the heat-shrinkable region 4' with the finger-like extensions 5 and 6 which are associated with the cable jacket 13 and the lead 9. This is therefore a mixed (hybrid) elastic/heat-shrinkable part. In this case, it is advisable to provide the inside surfaces of the shrinkable area with a hot-melting adhesive 15.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawing are, accordingly, to be regarded in an illustrative rather than in a restrictive sense.

What is claimed is:

1. In a single pole plug connector which is arranged at the end of a single conductor, shielded, plastic jacketed electric cable and in which a plug connector part is connected to a recessed end of the cable, the cable being surrounded by an insulator of elastomeric material which can be slipped over the cable end and sealed to the cable end, the cable shield comprising individual wires which are brought out of a back opening of the insulator and connected to a connecting lead via a compression joint, the improvement comprising:

(a) the shield wires being folded within the insulator back onto the jacket of the recessed cable end;

(b) a sealing sleeve surrounding the folded back shield wires;

(c) the insulator resting elastically with its entire inside surface on the recessed cable end;

(d) a thin lubricating and sealing layer interposed between the recessed cable end and the insulator;

(e) at the transition from the insulator to the cable, an elastic cap resting against the insulator, forming an elastic seal, and having two finger-like extensions, one extending over the cable jacket and the other enclosing the connecting lead and forming an elastic seal therewith; and (f) a hose clamp surrounding the cable and the connecting lead in the vicinity of the finger-like extensions.

2. A plug connector according to claim 1, wherein said elastic cap is coated on its inside surface with an adhesive.

3. A plug connector according to claim 1, wherein said insulator comprises a heat-shrinkable part in the region of the insulator which rests on the cable insulation and the cable jacket.

4. A plug connector according to claim 3, said elastic cap is coated on its inside surface with an adhesive.

5. A plug connector according to claim 1, and further including a further hose clamp fixing the elastic cap on the insulator, said further hose clamp resting laterally against a circular bead formed by the insulator at its cable side end.

6. A plug connector according to claim 5, wherein said elastic cap is coated on its inside surface with an adhesive.

7. A plug connector according to claim 3, and further including a further hose clamp fixing the elastic cap on the insulator, said further hose clamp resting laterally against a circular bead formed by the insulator at its cable side end.

8. A plug connector according to claim 4, wherein said elastic cap is coated on its inside surface with an adhesive.

9. A plug connector according to claim 3, wherein said elastic cap comprises a heat-shrinkable material and is formed in one piece with the insulator.

10. A plug connector according to claim 9, wherein said elastic cap is coated on its inside surface with an adhesive.

11. A plug connector according to claim 1, wherein said sealing sleeve is selected from the group consisting of a silicone grease layer, an elastic or a heat-shrinkable bandage.

12. A plug connector according to claim 11, wherein said sleeve comprises a heat-shrinkable bandage coated with an adhesive on its inside surface.

* * * * *